US006834666B2

(12) United States Patent
Murayama et al.

(10) Patent No.: US 6,834,666 B2
(45) Date of Patent: Dec. 28, 2004

(54) APPARATUS FOR OUTPUTTING COMPRESSED AIR IN COMPRESSOR

(75) Inventors: Keijiro Murayama, Tokyo (JP); Katsuhiko Murayama, Tokyo (JP); Hiroshi Hanagasaki, Tokyo (JP); Kazuhiko Kuraguchi, Tokyo (JP); Hajime Takemura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 359 days.

(21) Appl. No.: 10/092,352

(22) Filed: Mar. 7, 2002

(65) Prior Publication Data

US 2002/0124890 A1 Sep. 12, 2002

(30) Foreign Application Priority Data

Mar. 7, 2001 (JP) ..... P2001-063830
Mar. 7, 2001 (JP) ..... P2001-063831

(51) Int. Cl.[7] ..... F04B 41/02

(52) U.S. Cl. ..... 137/269; 137/461; 137/517; 137/561 R; 137/565.18; 137/883; 251/149.6

(58) Field of Search ..... 137/269, 461, 137/517, 561 R, 565.17, 565.18, 861, 883; 251/149.6

(56) References Cited

U.S. PATENT DOCUMENTS

| | | | | | |
|---|---|---|---|---|---|
| 103,252 | A | * | 5/1870 | Spear | 137/561 R |
| 2,720,217 | A | * | 10/1955 | Vossbrinck | 137/561 R |
| 2,831,501 | A | * | 4/1958 | Gummere | 137/561 R |
| 2,866,474 | A | * | 12/1958 | Gummere | 137/561 R |
| 2,994,339 | A | * | 8/1961 | Massey | 137/561 R |
| 3,095,899 | A | * | 7/1963 | Billington | 137/517 |
| 3,131,905 | A | * | 5/1964 | Nyberg | 251/149.6 |
| 3,170,667 | A | * | 2/1965 | Zoltan | 251/149.6 |
| 3,567,175 | A | * | 3/1971 | Sciuto, Jr. | 251/149.6 |
| 3,760,842 | A | * | 9/1973 | Mikiya | 137/557 |
| 4,091,840 | A | * | 5/1978 | Grove et al. | 137/561 R |
| 4,296,777 | A | * | 10/1981 | Rodemer | 137/269 |
| 4,480,654 | A | * | 11/1984 | Firey | 137/119.09 |
| 4,579,042 | A | | 4/1986 | Neff | |
| 4,683,905 | A | | 8/1987 | Vigneau et al. | |
| 4,870,994 | A | * | 10/1989 | Raymond | 137/883 |
| 5,038,819 | A | * | 8/1991 | Sutphen | 137/883 |
| 5,167,398 | A | * | 12/1992 | Wade et al. | 251/149.6 |
| 5,197,511 | A | * | 3/1993 | Kohn et al. | 137/269 |
| 5,294,092 | A | * | 3/1994 | Wade et al. | 251/149.6 |
| 5,435,342 | A | | 7/1995 | Kohn et al. | |
| 5,562,121 | A | | 10/1996 | Hodges et al. | |
| 5,967,188 | A | * | 10/1999 | Chien-Chuan | 137/883 |
| 5,992,456 | A | * | 11/1999 | Schumacher | 137/269 |
| 6,330,890 | B1 | * | 12/2001 | Ekman | 137/269 |
| 6,655,925 | B1 | * | 12/2003 | Robenalt et al. | 417/234 |

FOREIGN PATENT DOCUMENTS

| | | |
|---|---|---|
| DE | 195 15 895 A1 | 10/1996 |
| FR | 2 625 545 | 7/1989 |
| JP | 04298691 | 10/1992 |
| JP | 4-298691 | 10/1992 |

* cited by examiner

*Primary Examiner*—John Rivell
(74) *Attorney, Agent, or Firm*—Morgan, Lewis & Bockius LLP

(57) ABSTRACT

The invention provides an apparatus for outputting compressed air in a compressor to a plurality of pneumatic tools at a plurality of pressures. The apparatus includes: an air tank storing compressed air compressed by the compressor at a high pressure; a pressure adjusting portion connected to said air tank and adjusting a pressure value of the compressed air in a region from the high pressure to zero; a pressure outputting portion connected to a secondary side of said pressure adjusting portion and outputting the adjusted compressed air to at least one of a first pneumatic tool driven at a first pressure and a second pneumatic tool driven at a second pressure. The first pressure is larger than the second pressure, and the adjusted compressed air is not output to the second pneumatic tool at the first pressure.

7 Claims, 12 Drawing Sheets

APPARATUS FOR OUTPUTTING COMPRESSED AIR IN COMPRESSOR

BACKGROUND OF THE INVENTION

1. Field of the Invention

The present invention relates to a compressed air outputting apparatus for outputting compressed air of a compressor supplying compressed air to a tool driven by compressed air.

More specifically, the present invention relates to an apparatus of outputting compressed air in a compressor for supplying a high pressure exclusive pneumatic tool driven in a high air pressure region and a low pressure exclusive pneumatic tool driven in a low pressure region, with compressed air at pressures suitable for the respective exclusive pneumatic tools.

2. Description of the Related Art

According to a general portable air compressor for supplying compressed air to a tool driven by compressed air, there is stored compressed air at pressure of, for example, 10 through 30 kg/cm$^2$ produced by a compressing portion thereof driven by a motor in a tank and the compressed air is adjusted to pressure used by the tool by a reducing valve attached to the tank and supplied to a side of the tool via connecting means of a quick coupling unit or the like.

As a compressed air tool, there are a generally known a low pressure tool used at pressure equal to or lower than 10 kg/cm$^2$ and a high pressure tool used at high pressure equal to or higher than 10 kg/cm$^2$ for, for example, downsizing the tool or making the tool carry out high function operation. In order to be able to use the low pressure tool and the high pressure tool by one compressor, there is known a constitution in which compressed air at high pressure equal to or higher than 30 kg/cm$^2$ is stored in a tank, the tank is attached with a reducing valve exclusively used for low pressure (normal pressure) and a reducing valve exclusively used for high pressure, the respective reducing valves are connected with sockets of coupling units exclusively used for the low pressure tool and exclusively used for the high pressure tool and the respective tools can be supplied with compressed air at respectively adjusted pressures. Further, in order to prevent the two kinds of tools from being supplied with compressed air at inappropriate pressure by erroneous connection, there are used fluid couplings which are not compatible to each other in connecting to the tank of the compressor, further, also with regard to the reducing valves attached to the tank of the compressor, there are used the reducing valves for high pressure and for low pressure having different maximum output pressures such that compressed air at high pressure cannot erroneously be supplied to the low pressure tool. Further, according to the reducing valve used exclusively for low pressure, the maximum output pressure is restricted such that an upper limit of a pressure range used in the low pressure tool is not exceeded thereby.

According to the above-described compressor, both of the high pressure tool and the low pressure tool can be used, further, respective pieces of the two tools can simultaneously be used, the two tools can be connected via the exclusive sockets which are not compatible to each other and therefore, erroneous connection is eliminated and a phenomenon such as destruction of the low pressure tool or a deterioration in the function of the high pressure tool can be prevented.

As mentioned above, as a compressed air tool, there are a generally known a low pressure pneumatic tool used at pressure equal to or lower than 10 kg/cm$^2$ and a high pressure pneumatic tool used at high pressure equal to or higher than 10 kg/cm$^2$ for, for example, downsizing the tool or making the tool carry out high function operation. According to the low pressure pneumatic tool and the high pressure pneumatic tool, there are used fluid coupling units which are not compatible to each other in connecting to a supply source of compressed air such that compressed air at inappropriate pressure is not supplied by erroneous connection.

For example, as shown by JP-A-4-298691, there is known a constitution in which in order that a low pressure tool and a high pressure tool can be used by one compressor, compressed air at high pressure equal to or higher than 30 kg/cm$^2$ is stored in a tank, the tank is attached with a reducing valve used exclusively for low pressure and a reducing valve used exclusively for high pressure, the respective reducing valves are connected with sockets of quick coupling units exclusive for a low pressure pneumatic tool and a high pressure pneumatic tool and compressed air at pressures adjusted by the respective reducing valves is supplied to the respective tools. In this case, according to the reducing valve used exclusively for low pressure, a maximum output pressure is restricted to prevent from exceeding an upper limit of a pressure range used in the low pressure pneumatic tool.

According to the above-described compressor, both of the high pressure pneumatic tool and the low pressure pneumatic tool can be used. Further, respective pieces of the two tools can simultaneously be used, and the two tools can be connected via the exclusive sockets which are not compatible to each other. Therefore, erroneous connection is eliminated and a phenomenon such as destruction of the low pressure tool or a deterioration in the function of the high pressure tool can be prevented.

However, in order to use two pieces of either of the low pressure tool or the high pressure tool by the above-described compressor, it is necessary to newly install a unit of the exclusive reducing valve and the exclusive socket, or attach a plurality of pieces of sockets in parallel to the low pressure reducing valve or the high pressure reducing valve. In the former case, when respective two pieces of the high pressure tools and the low pressure tools are simultaneously used, it is necessary to install a total of four pieces of the reducing valves of respective two pieces of the high pressure reducing valves and the low pressure reducing valves. Further, in the latter case, although there may be provided two pieces, in total, of a single piece of the reducing valve, pressure supplied to the two tools used at low pressure or high pressure stays the same. Accordingly, when operation is carried out at pressures different for the respective tools, for example, when operation capable of being carried out at low pressure such as building an inner wall by one piece of a nailing machine and operation needing comparatively large striking force for an operated body of a pillar, a foundation or the like by other nailing machine, even the same low pressure tool cannot be used by setting adjusted pressure suitable for respective operation.

Further, according to an apparatus shown in JP-A-4-298691, the similar problem arises. That is, according to the apparatus of outputting compressed air of a compressor, in order to simultaneously use two pieces of either of the low pressure pneumatic tools or the high pressure pneumatic tools, it is necessary to newly install respectively exclusive units of reducing valves and sockets, or attach a plurality of pieces of sockets in parallel to the low pressure reducing valve or the high pressure reducing valve. That is, when two pieces of the high pressure tools are simultaneously used, two pieces of sockets for high pressure are needed. When two pieces of low pressure tools are used, two pieces of sockets for low pressure are needed. In consideration of using respective two pieces of the low pressure tools and the high pressure tools, it is necessary to install a total of four pieces of sockets and these must be arranged along an outer face of the compressor and therefore, there is constituted a factor of hampering to downsize formation of the compressor. Further, there are used sockets used respectively exclusively for high pressure and low pressure, which are not compatible to each other and outlooks of which are formed substantially in the same shape. Therefore, when a plug attached to a hose connected to the side of the tool is connected, the plug may be operated to connect to a wrong socket. Since the sockets are not compatible to each other, compressed air is not connected to the wrong one, however, operation in connection is made troublesome.

SUMMARY OF THE INVENTION

Accordingly, it is an object of the invention to provide an apparatus of outputting compressed air of a compressor capable of simultaneously using each piece of a high pressure tool and a low pressure tool and capable of simultaneously using two pieces of the low pressure tool or the high pressure tool while reducing a number of attached reducing valves.

Further, it is another object of the invention to provide an apparatus of outputting compressed air of a compressor capable of simultaneously using single pieces of tools of high pressure and low pressure and simultaneously using two pieces of low pressure tools or high pressure tools. Further, resolving trouble of connecting operation with no necessity of ascertaining a socket to be connected when a plug on a side of a tool is connected by reducing a number of sockets for outputting compressed air.

In order to resolve the above-described problem, according to the invention, there is provided an apparatus of outputting compressed air of a compressor characterized in including an air tank for storing compressed air at a high pressure, a reducing valve attached to the tank and capable of arbitrarily adjusting a pressure value in a region from a high pressure to a low pressure, a socket used exclusively for the high pressure connected to a secondary side of the reducing valve, a socket used exclusively for the low pressure connected to the secondary side of the reducing valve via an opening/closing valve, and an opening/closing valve control apparatus for controlling to close the opening/closing valve when a secondary side adjusting pressure of the reducing valve exceeds a predetermined pressure value.

Further, it is preferable that the air tank is installed with a plurality of units each having the reducing valve, the sockets exclusively used for the high pressure and the low pressure, and the opening/closing valve control apparatus.

According to the invention, there may be constructed a constitution of an apparatus of outputting compressed air of a compressor, wherein a reducing valve capable of arbitrarily adjusting a pressure value at a region from a high pressure to a low pressure is attached to an air tank for storing compressed air at a high pressure, plugs of a low pressure tool and a high pressure tool are made to be able to be mounted to a socket connected to a secondary side of the reducing valve, the socket is installed with an opening/closing valve for opening and closing a path communicated to a side of the plug in accordance with a pressure of the compressed air supplied from the air tank and the opening/closing valve is made to operate to close when the pressure exceeds a limit pressure of using the low pressure tool.

Further, in order to resolve the problem in the above-described conventional technology, according to the invention, there is provided an apparatus of outputting compressed air of a compressor which is a compressor driven at compressed air pressures of a high pressure and a low pressure for supplying compressed air to respective compressed air tools of a high pressure and a low pressure respectively attached with exclusive plugs, the compressor characterized in including respective reducing valves used exclusively for the high pressure and used exclusively for the low pressure attached to an air tank stored with compressed air at a high pressure and a socket connected to secondary sides of the reducing valves for forming ports of outputting compressed air to the compressed air tools wherein the socket includes respective ports of the high pressure and the low pressure connected to the secondary sides of the two reducing valves and a plug receiving portion capable of mounting both of the respective exclusive plugs of the low pressure and the high pressure attached to the tools and the respective ports are selectively conducted to the respective exclusive plugs in a state of mounting the respective exclusive plugs to the plug receiving portion of the socket.

Further, according to the invention, the inside of the socket is arranged with a switch valve member operated by mounting the respective exclusive plugs and the switch valve selects to connect the ports of the high pressure and the low pressure communicated to the secondary sides of the respective reducing valves to a side of the plug receiving portion by making strokes of operating to move the switch valve member differ from each other by mounting the respective exclusive plugs.

DETAILED DESCRIPTION OF THE PREFERRED EMBODIMENTS

Figure 1:
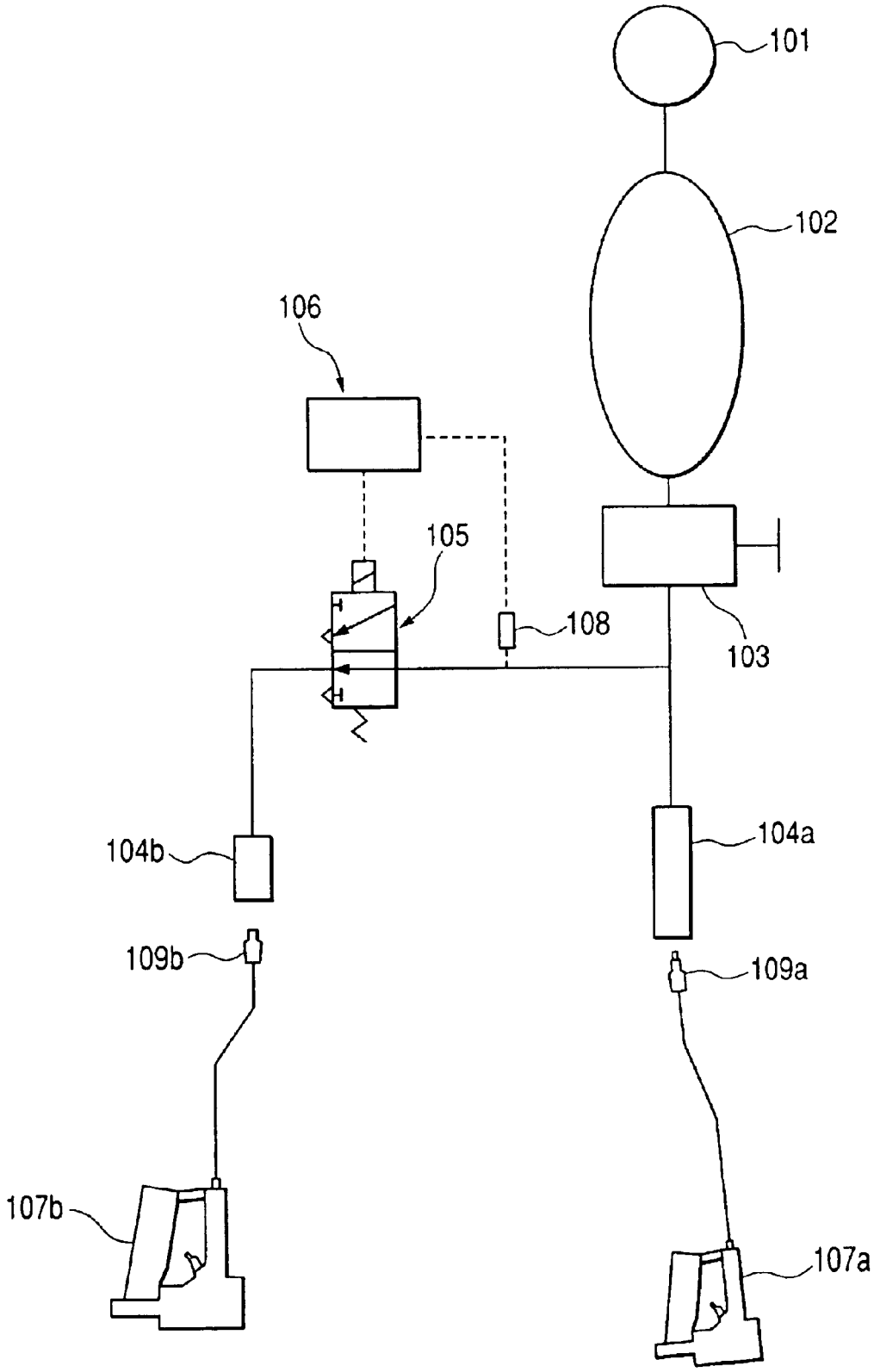
FIG. 1 is a block diagram showing an outline of an apparatus of outputting compressed air of a compressor.

FIG. 1 shows an outline of an apparatus of outputting compressed air of a compressor and the compressed air outputting apparatus, according to the first embodiment of the invention, is constituted by an air tank 102 connected to a compressor 101 for storing compressed air at high pressure, a reducing valve 103 attached to the air tank 102, a socket 104*a* exclusively used for high pressure connected to a secondary side of the reducing valve 103, a socket 104*b* exclusively used for low pressure (normal pressure) connected to the secondary side of the reducing valve 103 via an opening/closing valve 105 and an opening/closing valve control apparatus 106 for controlling to open or close the opening/closing valve 105.

The tank 102 is stored with compressed air at high pressure, for example, exceeding 30 kg/cm$^2$ produced by the high pressure compressor 101, the reducing valve 103 is attached to the tank 102 and is of a type by which a secondary side pressure value can arbitrarily be adjusted in a range of 130 through 0 kg/cm$^2$ and compressed air adjusted in a total region of the pressure range from low pressure to high pressure, can be output to the secondary side after the pressure has been reduced.

The socket 104*a* used exclusively for high pressure and the socket 104*b* used exclusively for low pressure are formed in shapes which are not compatible to each other to prevent from being connected erroneously to a high pressure tool 107*a* and a low pressure tool 107*b*, respectively.

Next, the opening/closing valve 105 connected to the secondary side of the reducing valve 103 is a 3-ports electromagnetic valve. There is provided a pressure sensor 108 for detecting secondary side adjusted pressure of the reducing valve 103 between the reducing valve 103 and the electromagnetic valve 105. Further, the opening/closing valve 105 is constituted to connect compressed air at secondary side pressure of the reducing valve 103 to the socket 104*b* used exclusively for low pressure or cut the compressed air therefrom.

Figure 2:
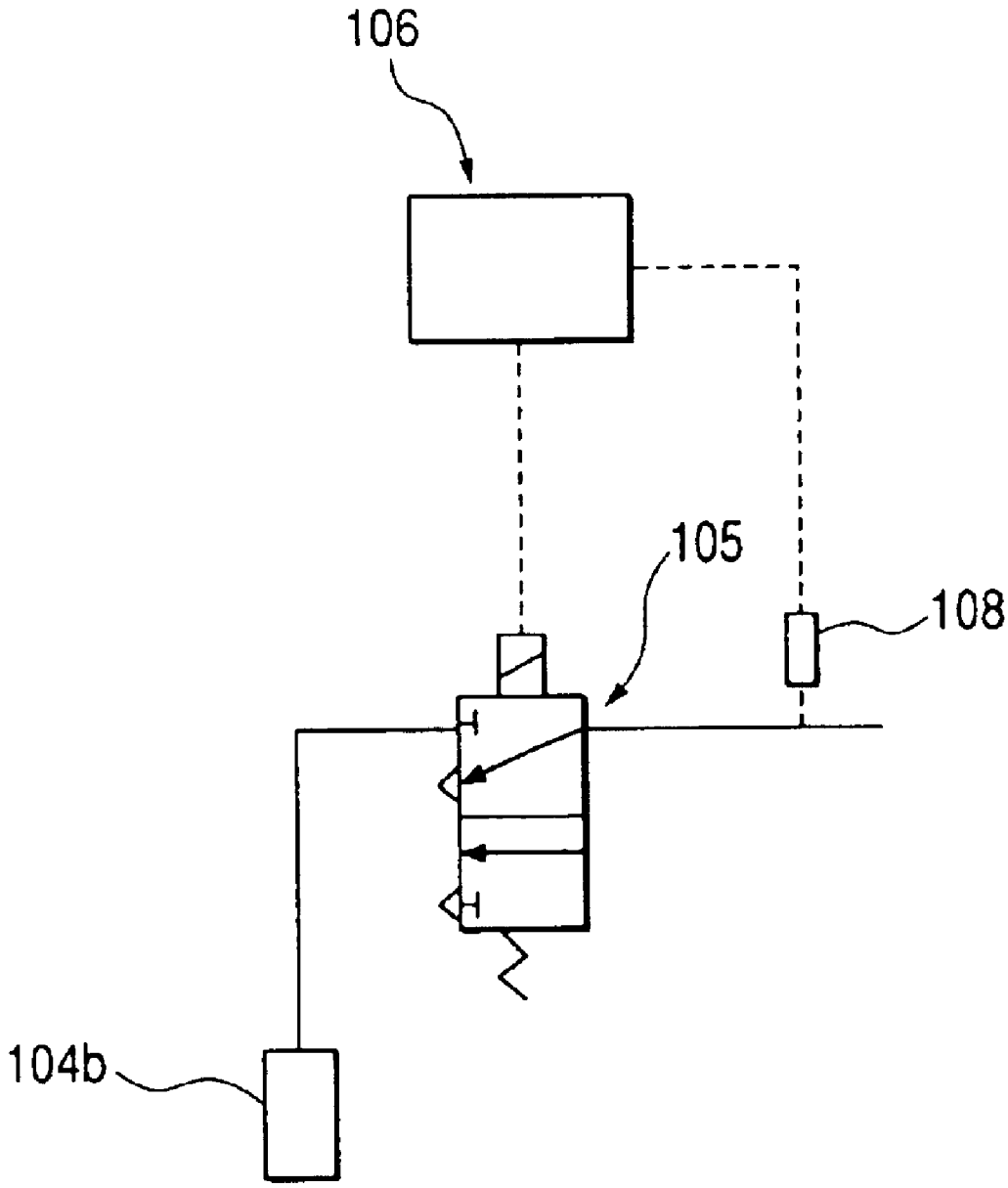
FIG. 2 is a view for explaining a mode of opening an opening/closing valve of the compressed air outputting apparatus.

The opening/closing valve control apparatus 106 is an electromagnetic valve drive circuit for controlling to open or close the opening/closing valve 105 by a detected value of the pressure sensor 108 for detecting the secondary side pressure and is operated to close the opening/closing valve 105 by the sensor 108 as shown by FIG. 2 when the secondary side pressure of the reducing valve 103 exceeds a predetermined pressure value in the range of low pressure, for example, 10 kg/cm$^2$.

According to the compressed air outputting apparatus having the above-described constitution, the reducing valve 103 reduces pressure of compressed air adjusted in the total region of the pressure range from low pressure to high pressure and outputs the compressed air to the secondary side, and the secondary side of the reducing valve 103 is attached with the socket 104*a* used exclusively for high pressure and the socket 104*b* used exclusively for low pressure. The socket 104*a* exclusively used for high pressure is connected with a plug 109*a* of the high pressure tool 107*a*, and the socket 104*b* used exclusively for low pressure is connected with a plug 109*b* of the low pressure tool 107*b* to thereby use the apparatus. Therefore, the apparatus can be used for low pressure and for high pressure.

Further, the plug 109*b* of the low pressure tool 107*b* can be supplied only with compressed air at limit pressure or lower via the opening/closing valve 105 by the opening/closing valve control apparatus 106, and the low pressure tool 107*b* is not supplied with compressed air at proper pressure or higher. Therefore, destruction of the tool or a connection hose thereof can be prevented.

Figure 3:
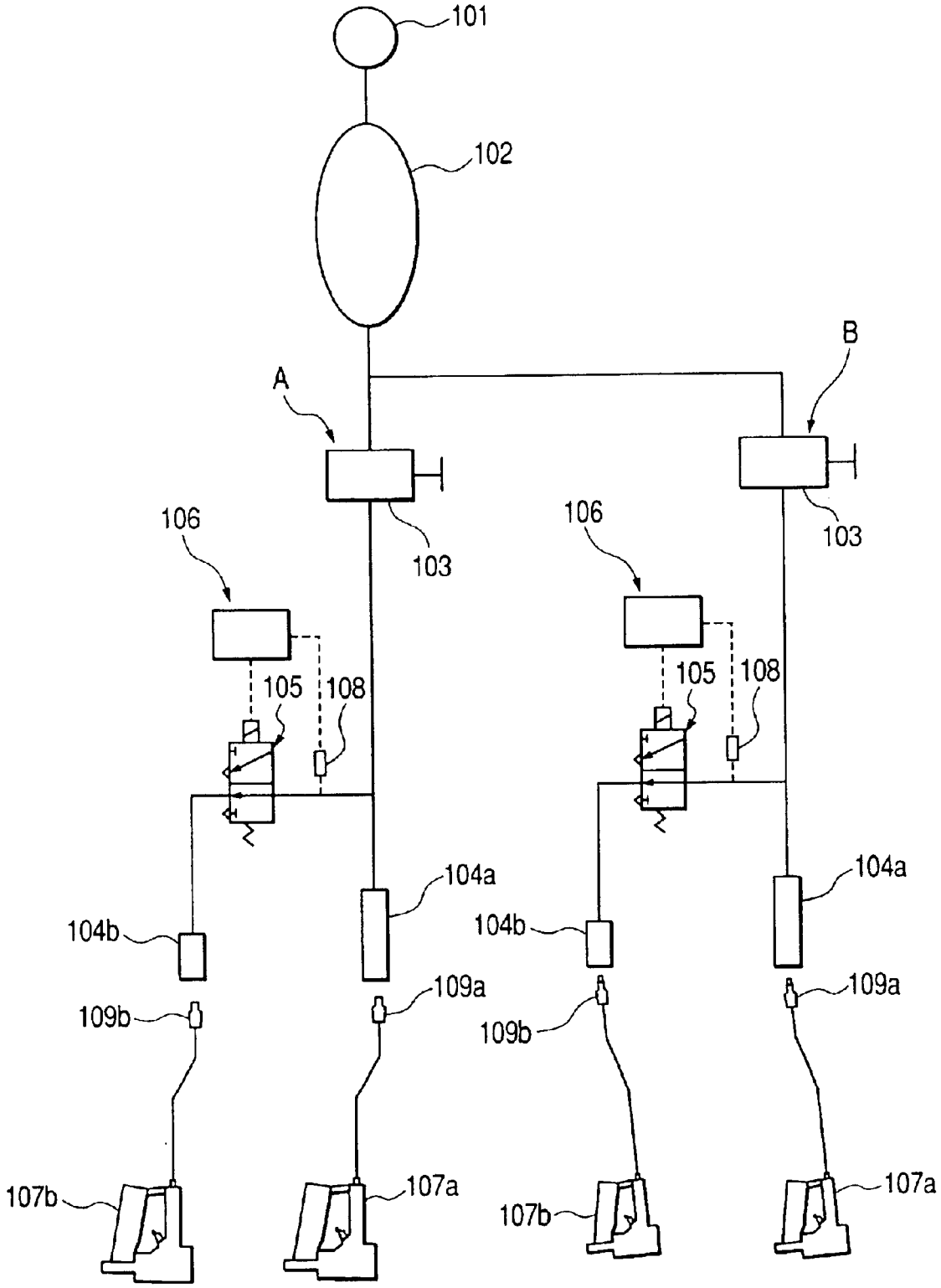
FIG. 3 is a block diagram showing an outline of another example of an apparatus of outputting compressed air of a compressor.

Next, FIG. 3 shows an example of installing two pieces of units A and B each having the reducing valve 103, the sockets 104*a* and 104*b* used exclusively for high pressure and low pressure and the opening/closing valve control apparatus 106 at the tank. In this case, each of the units A and B can be connected with one of the high pressure tool 107*a* or the low pressure tool 107*b* and therefore, single pieces of the pressure tool 107*a* and the low pressure tool 107*b* can simultaneously be used for the respective units A and B.

Further, when each of the units A and B is constituted to be able to connect the high pressure tool 107*a* and the low pressure tool 107*b*, respectively, two pieces of the low pressure tools or two pieces of the high pressure tools can simultaneously be used. Further, respective pressures used by two pieces of the low pressure tools or the high pressure tools can be adjusted and compressed air at pressure suitable for operating the tool can be output.

Further, according to the above-described constitution, only two of the common reducing valves are used for the expensive reducing valves and the compressor 101 having excellent way of use at low cost can be provided by only adding the simple opening/closing valve 105 and the control apparatus.

Figure 4:
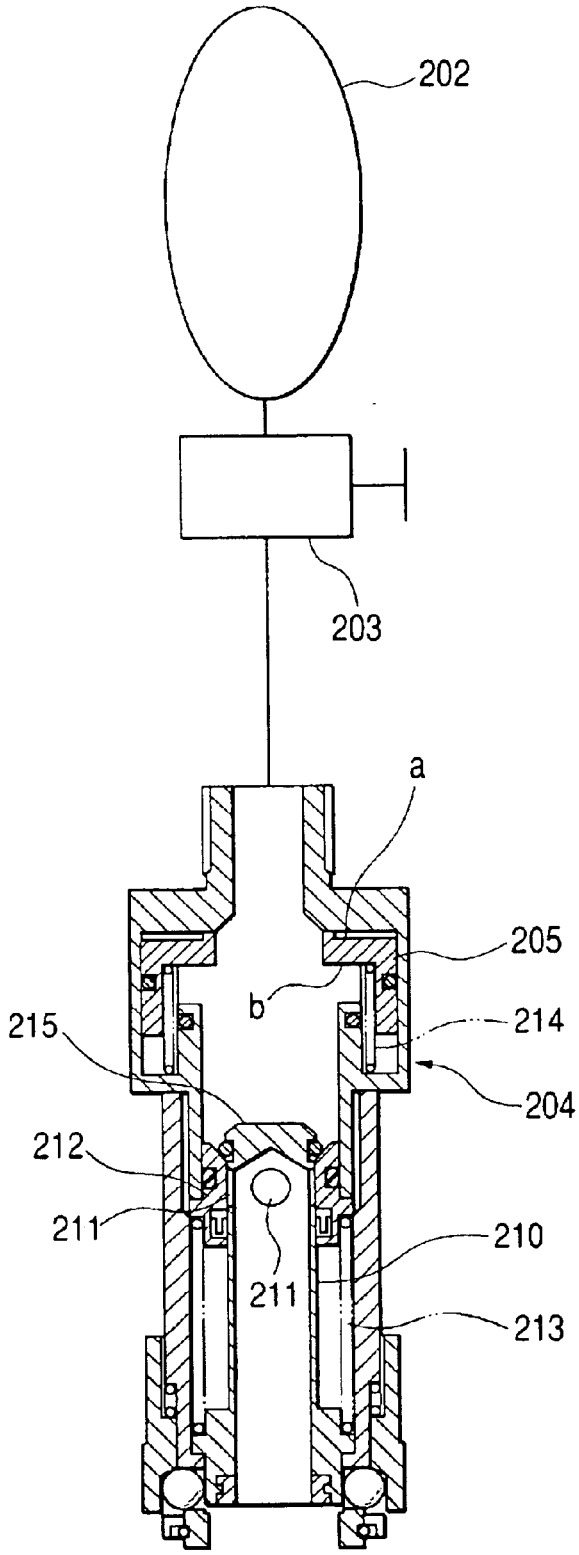
FIG. 4 is an outline view of another example of an apparatus of outputting compressed air of a compressor.
Figure 5C:
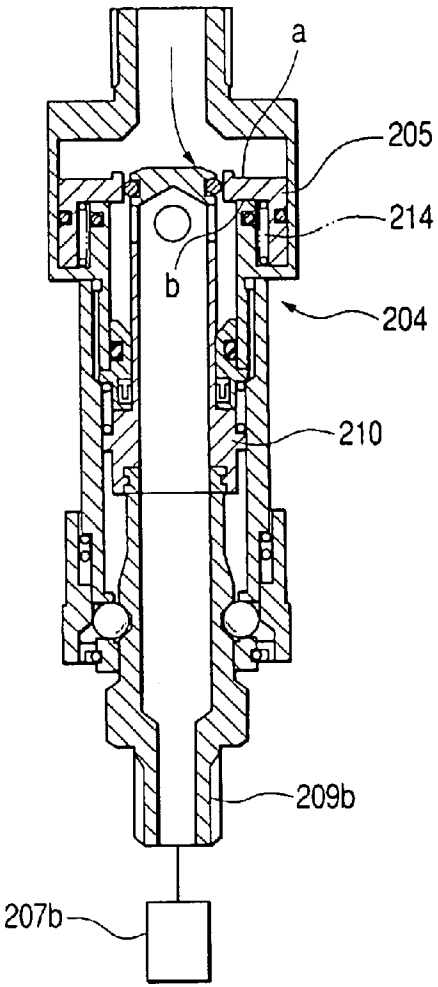
FIGS. 5(*a*) and 5(*b*) are explanatory views of operational modes when a high pressure tool and a low pressure tool are connected respectively, and FIG. 5(*c*) is an explanatory view of an operational mode when the low pressure tool is connected.
Figure 5B:
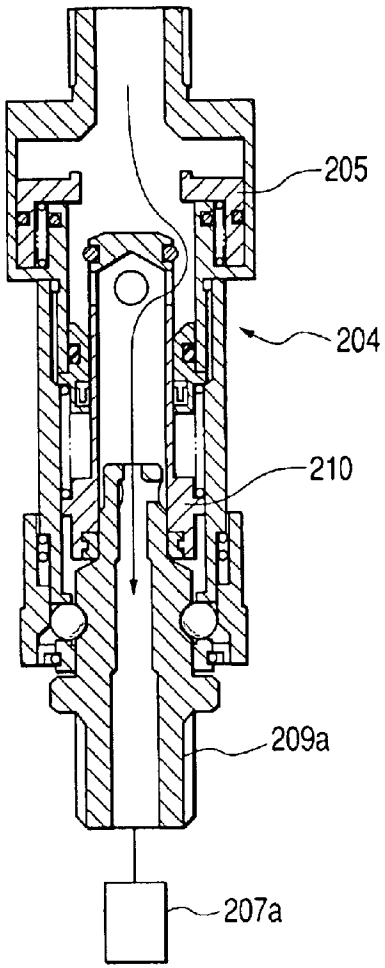
Figure 5A:
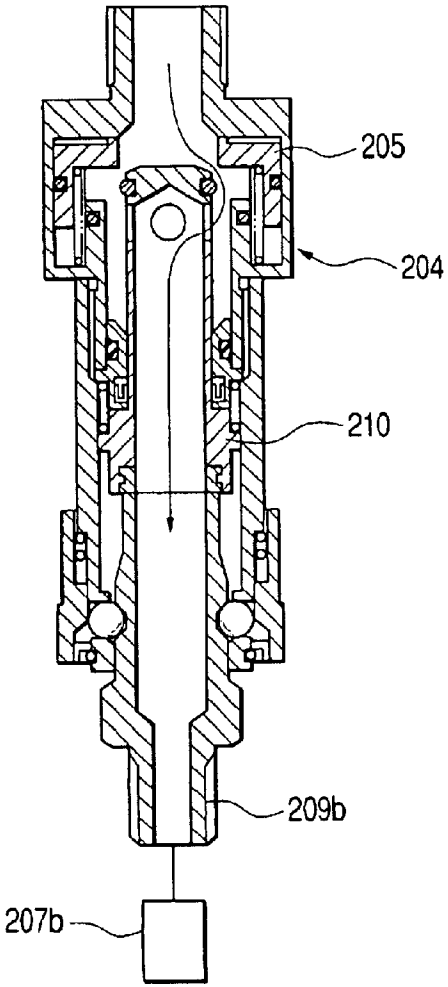

Next, FIG. 4 shows another example of an apparatus of outputting compressed air of a compressor. According to this example, there is attached a socket 204 installed with the opening/closing valve 205 for opening and closing a path of compressed air in response to the secondary side pressure of the reducing valve 203. Further, as shown by FIGS. 5(*a*) and 5(*b*), the socket 204 is formed to be able to be mounted with either of the plugs 209*a* and 209*b* of the high pressure tool 207*a* and the low pressure tool 207*b* and the opening/closing valve 205 is constituted to operate to close only when the opening/closing valve 205 is mounted with the plug 209*b* of the low pressure tool 207*b*.

That is, in the drawings, the socket 204 is common to the plug 209*b* of the low pressure tool 207*b* and the plug 209*a* of the high pressure tool 207*a*, and a cut-off valve member 210 is slidably arranged at the inside of the socket 204. The cut-off valve member 210 is formed in a shape of a bottomed cylinder and is opened to an opening side of the socket 204. An opening portion 211 is formed to penetrate a side face of a closing side of the cut-off valve member 210 and the opening portion 211 is constituted to be able to be brought into contact with and separated from a seal portion 212 formed to project from an inner wall of the socket 204 when the opening portion 211 is slidingly moved. As mentioned later, by operating the cut-off valve member 210, a path communicated to the side of the plug is opened and closed in accordance with pressure of compressed air supplied from the air tank 202.

In contrast thereto, although shapes and dimensions of portions of the plug 209*b* of the low pressure tool 207*b* and the plug 209*a* of the high pressure tool 207*a* to be mounted to the socket 204 are constituted to be the same, positions and dimensions of portions thereof to be engaged with the cut-off valve member 210 are constituted to differ from each other. That is, as shown by FIG. 5(*a*), a front end of the plug 209*b* of the low pressure tool 207*b* is formed to be larger than an inner diameter of the cut-off valve member 210 and in contrast thereto, as shown by FIG. 5(*b*), a front end of the plug 209*a* of the high pressure tool 207*a* is formed to be smaller than the inner diameter of the cut-off valve member 210. Further, the cut-off valve member 210 is urged to normally move to a movement end of the opening side of the socket 204 by a spring 213.

Further, the inside of the socket 204 is arranged with the opening/closing valve 205 in a ring-like shape urged by spring force. The opening/closing valve 205 is formed with pressure receiving faces a and b for receiving compressed air supplied into the socket 204 from the compressor 201 via the reducing valve 203, and the opening/closing valve 205 is moved against the spring force of the spring 213 by operating air at predetermined pressure or higher on the pressure receiving faces a and b. At this occasion, the opening/closing valve 205 is arranged engageably to the seal portion 212 provided at a surrounding of a front end portion of the cut-off valve member 210.

According to the above-described constitution, as shown by FIGS. 5(*a*) and 5(*b*), the low pressure plug 209*b* and the high pressure plug 209*a* can be connected to the socket 204, and the socket 204 is opened by the connection. Therefore, the compressed air can be output from the opening portion 211 of the cut-off valve member 210 to the respective plug by passing through the socket 204 from the reducing valve 203. Further, since the front end of the plug 209*b* for low pressure is larger than the inner diameter of the cut-off valve member 210, the front end of the plug 209*b* presses the cut-off valve member 210 while being engaged with a rear end of the cut-off valve member 210. However, the front end of the plug 209*a* for high pressure presses the cut-off valve member 210 in a state of being brought into the inner side of the cut-off valve member 210. Therefore, an amount of pressing the cut-off valve member 210 when connected to the socket 204 is larger in the case of the plug 207*b* for low pressure than in the case of the plug 207*a* for high pressure.

Meanwhile, in connecting low pressure plug 209*b*, when air pressure of compressed air from the reducing valve 203 becomes equal to or higher than predetermined pressure (limit pressure in using low pressure tool), since an area of the pressure receiving face a of the opening/closing valve 205 is larger than an area of the pressure receiving face b, as shown by FIG. 5(*c*), the opening portion 211 is operated against the spring force of the spring 214 and is engaged with the seal portion provided at the surrounding of the front end portion of the cut-off valve member 210. Therefore, flow of air to the side of the plug 209*b* is closed. Therefore, pressure equal to or higher than the limit pressure is not supplied to the tool for low pressure.

In contrast thereto, even when the high pressure plug 209*a* is mounted, the opening/closing valve 205 is moved against the spring force in response to high supply pressure; however, the amount of moving the cut-off valve member 210 in this case is small, and the cut-off valve member 210 is not engaged. Therefore, the path of compressed air is not closed, and compressed air flows in the high pressure tool in the total region from low pressure to high pressure.

According to the above-described constitution, by a constitution in which the sensor for detecting pressure, an electromagnetic valve or the like is not used, compressed air at the limit pressure or higher can be made to stop supplying to the tool for low pressure. Further, by the constitution, the socket 204 can be constructed by a structure common to high pressure and to low pressure, cost can be reduced by reducing a number of the sockets 204 installed to the compressor 201, and trouble of selecting the socket 204 in mounting the plug can be resolved.

Further, when the compressed air outputting apparatus having the above-described constitution is added with a sensor for detecting pressure and a control apparatus for operating the opening/closing valve 105 as shown by FIG. 1, pressure of driving the low pressure tool can be changed by changing the detected pressure of the sensor.

Hereinafter, other embodiments of the invention are described in detail.

Figure 6:
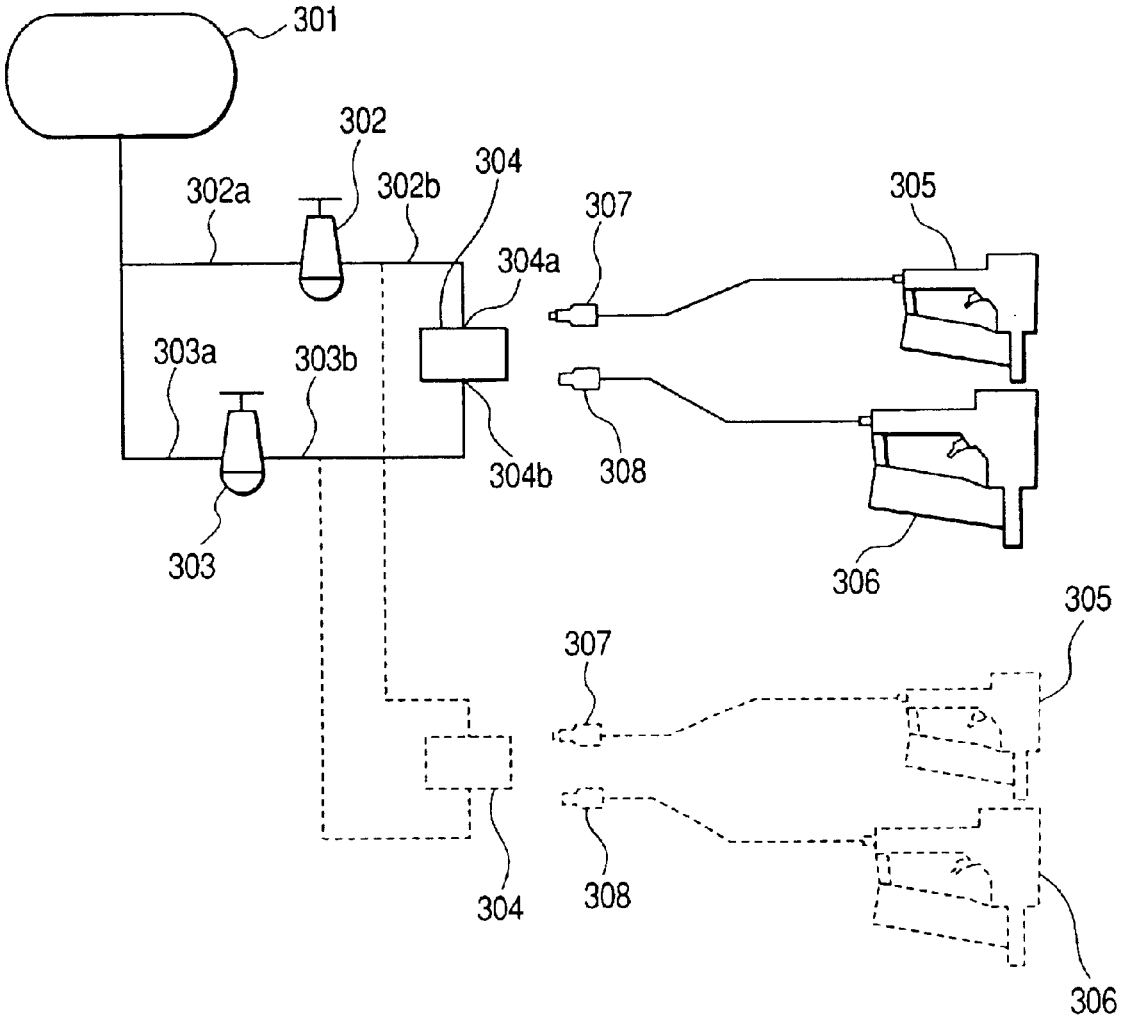
FIG. 6 is a conceptual view showing a system of a compressed air tool by a compressed air outputting apparatus according to the invention.

FIG. 6 is a view conceptually showing a system of a pneumatic nailing machine as another example of a compressor and a compressed air tool embodying a compressed air outputting apparatus according to the invention. A tank 301 is stored with compressed air at high pressure exceeding 30 kg/cm$^2$ produced by a high pressure compressing portion, not illustrated. As reducing valves connected to the tank 301, the tank 301 is connected with a high pressure reducing valve 302 used exclusively for high pressure having a secondary side pressure value adjustable in a range of 30 through 0 kg/cm$^2$ and a low pressure reducing valve 303 used exclusively for low pressure having maximum pressure of 10 kg/cm$^2$ respectively via tank sides 302*a* and 303*a* thereof. The respective reducing valves 302 and 303 used exclusively for low pressure and high pressure adjust to reduce pressure of compressed air arbitrarily adjusted to respective pressure ranges and output the compressed air to secondary sides 302*b* and 303*b* thereof.

Figure 7:
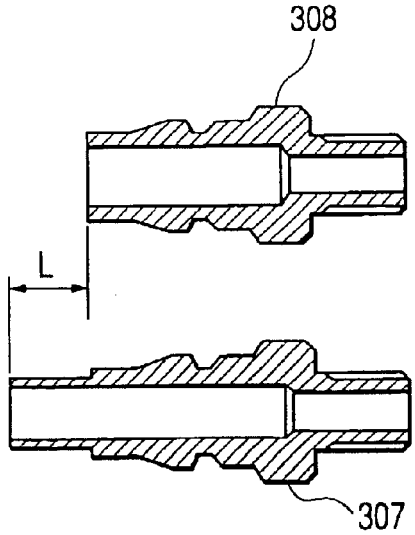
FIG. 7 is a side view showing an example of a plug used in the compressed air outputting apparatus according to the invention.

A socket 304 forming ports of outputting compressed air are formed with ports 304*a* and 304*b* connected to the secondary sides 302*b* and 303*b* (adjusted pressure air) of the respective reducing valves 302 and 303. A plug receiving portion of the socket 304 is constituted to be able to receive and mount both of respective plugs used exclusively for high pressure and used exclusively for low pressure. As shown by FIG. 7, plugs 307 and 308 used exclusively for high pressure and low pressure attached to respective nailing machines 305 and 306 of high pressure and low pressure, are constituted such that outer diameter shape of portions thereof mounted to the socket 304 are formed to be the same, lengths of front end portions projected in a front end direction are formed to differ, and lengths thereof projecting into the socket 304 differ from each other by an L dimension in a state of being mounted to the socket 304. Compressed air of the secondary sides 302*b* and 303*b* of the respective reducing valves 302 and 303 are selectively connected to the plugs 307 and 308 in accordance with the respective exclusive plugs 307 and 308 mounted to the plug receiving portion.

An explanation will be given of a constitution of a socket 310 according to a second embodiment of the invention in reference to FIG. 8 through FIG. 10. The inside of the socket 310 is provided with a cut-off valve 311 for cutting off air supplied from the reducing valves 302 and 303 in a state in which the plug is not mounted, and an end portion 312 of the cut-off valve 311 is arranged to be opposed to a plug mounting portion 313. Other end side of the cut-off valve 311 is integrally formed with a hollow valve member 314 constituting a switch valve, and the hollow valve member 314 is slidably arranged at the inside of a valve cylinder 315 in a cylindrical shape forming the socket 310. The valve cylinder 315 is formed with a high pressure port 316 and a low pressure port 317 connected to the secondary sides 302*a* and 303*a* of the two reducing valves 302 and 303 and a plurality of O-rings 318*a*, 318*b*, 318*c*, 318*d* and 318*e* formed at an outer periphery of the hollow valve member 314, selectively communicate the respective ports 316 and 317 to a side of the plug.

Figure 8:
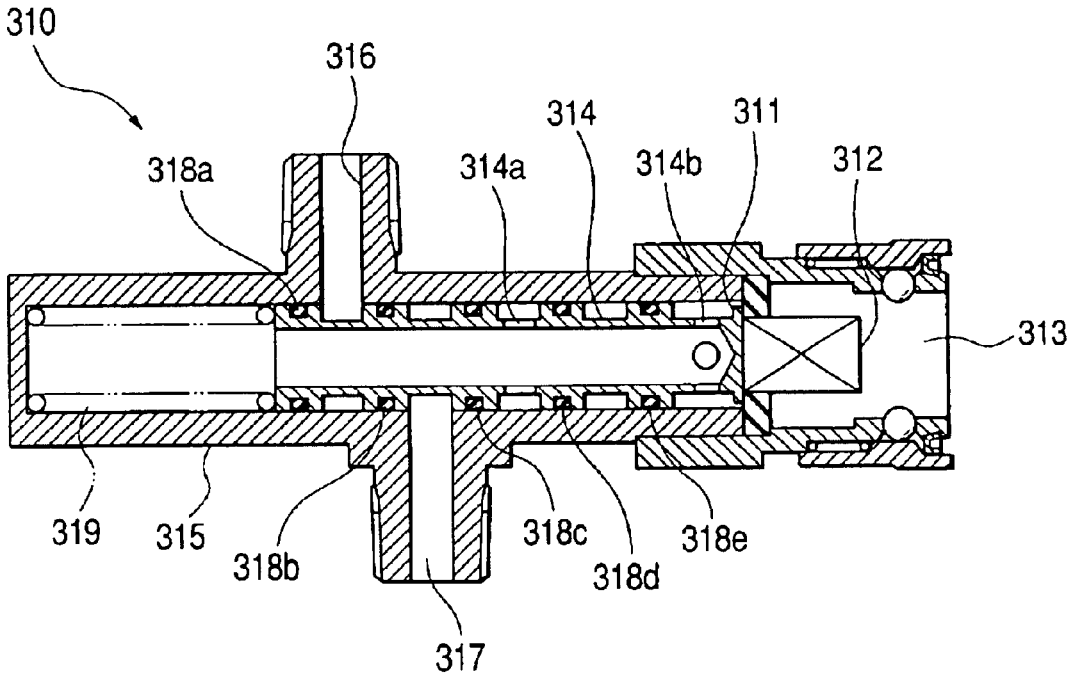
FIG. 8 is a sectional view showing a socket of a compressed air outputting apparatus according to a second embodiment of the invention.
Figure 9:
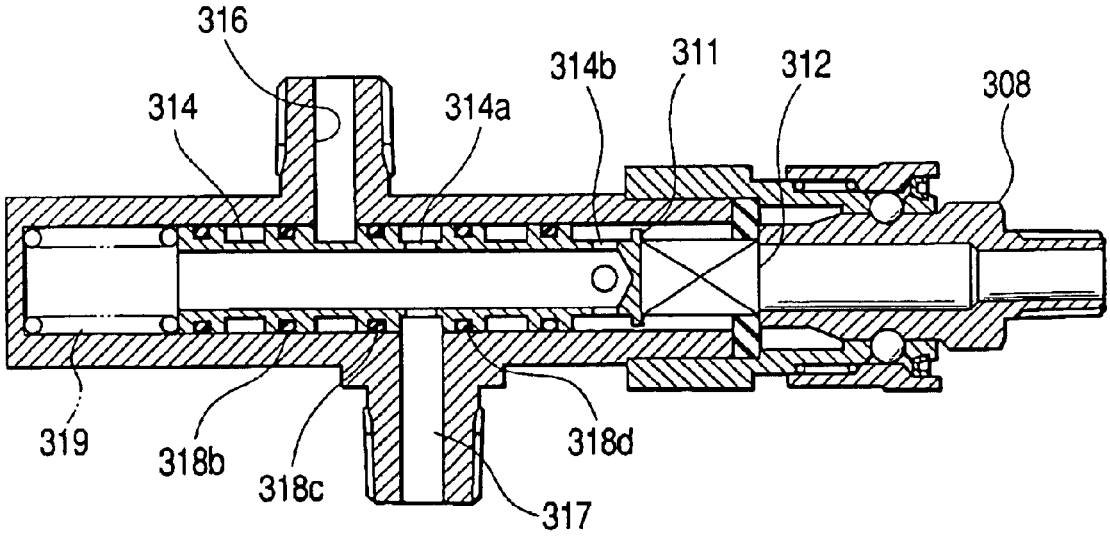
FIG. 9 is a sectional view the same as FIG. 8 in a state of mounting a low pressure plug.

In a normal state in which the plug is not mounted, as shown by FIG. 8, the hollow valve member 314 is arranged to a state in which both of the two ports 316 and 317 are cut off by a spring 319 operated to an end of the hollow valve member. When the low pressure plug 308 is mounted to the socket 310, as shown by FIG. 9, the end portion 312 of the cut-off valve 311 is pressed to move by the front end of the low pressure plug 308 and opens the cut-off valve 311 to thereby communicate the inside of the socket 310 and the side of the low pressure plug 308. At the same time, the hollow valve member 314 is moved by moving the cut-off valve 311, the low pressure port 317 and the inside of the hollow valve member 314 are communicated via an opening 314*a* formed at the outer periphery of the valve member 314, and the inside of the hollow valve member 314 and the inside of the socket 310 are communicated via an opening 314*b* formed at a vicinity of the end portion of the hollow valve member 314. Thereby, the low pressure port 317 is connected to the side of the low pressure plug 308 and compressed air at pressure adjusted by the low pressure reducing valve 303 is supplied to the low pressure plug 308.

Figure 10:
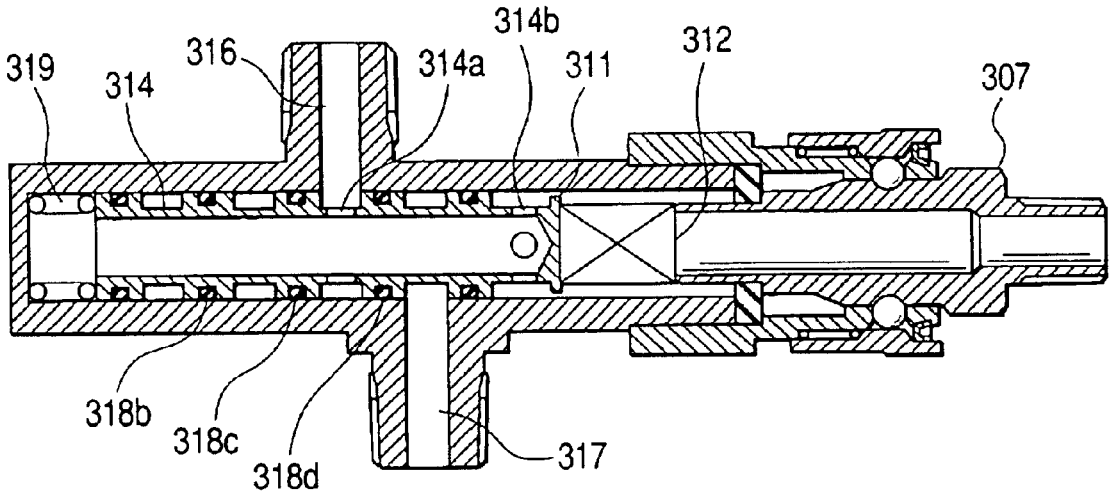
FIG. 10 is a sectional view the same as FIG. 8 in a state of mounting a high pressure plug.

As shown by FIG. 10, in the case of mounting the plug 307 used exclusively for high pressure to the socket 310, since the length of projecting in the front end direction is set to be larger than that of the low pressure plug 308, when the high pressure plug 307 is mounted, the cut-off valve 311 is moved by a larger amount. Accordingly, the opening 314*a* of the hollow valve member 314 communicates the high pressure port 316, and the inside of the hollow valve member 314 and pressurized air adjusted by the high pressure reducing valve 302 is supplied to connect to the mounted high pressure plug 307 via the opening 314*b* formed at the hollow valve member 314. Further, although in a procedure of mounting the high pressure plug 307, the hollow valve member 314 is temporarily communicated to the low pressure port 317, no problem is posed since compressed air at the low pressure is supplied to the high pressure pneumatic tool 305.

Figure 11:
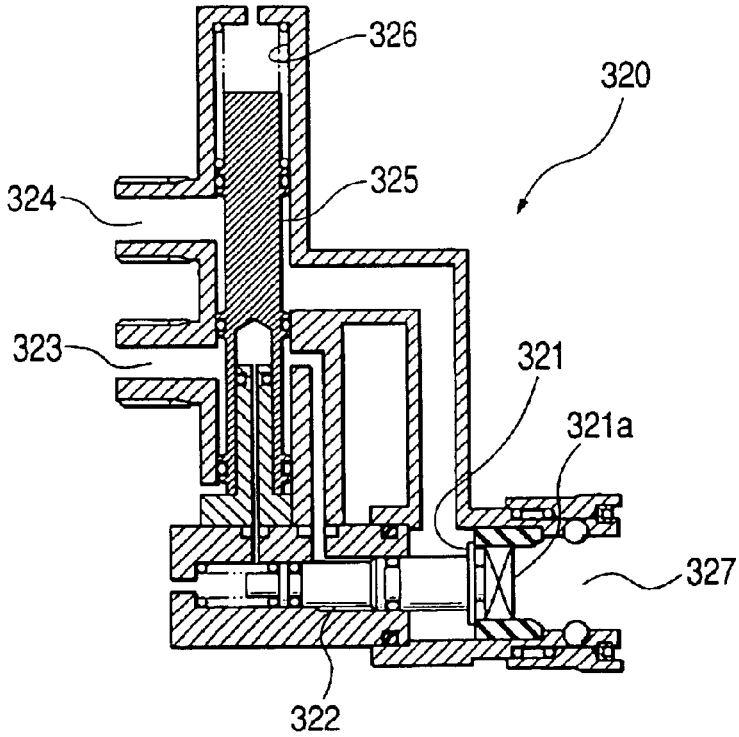
FIG. 11 is a sectional view showing a socket of a compressed air outputting apparatus according to a third embodiment of the invention.

Next, an explanation will be given of a third embodiment shown by FIG. 11 through FIG. 13. A socket 320 according to the embodiment is formed with a pilot valve 322 integrally formed with a cut-off valve 321 for cutting off air supplied from the reducing valve in a state in which neither of the plugs is mounted. Further, there is provided a switch valve 325 operated to switch to select a high pressure port 323 and a low pressure port 324 connected to the secondary sides of the two reducing valves 302 and 303 by air pressure supplied from the pilot valve 322 at the inside of the socket 320. As shown by FIG. 11, in a normal state in which the plug is not mounted, the switch valve 325 is disposed at a position of communicating the low pressure port 324 to the inside of the socket by a spring 326 and is moved to a position at which the high pressure port 323 is connected to the inside of the socket 320 by pilot air supplied from the pilot valve 322.

Figure 12:
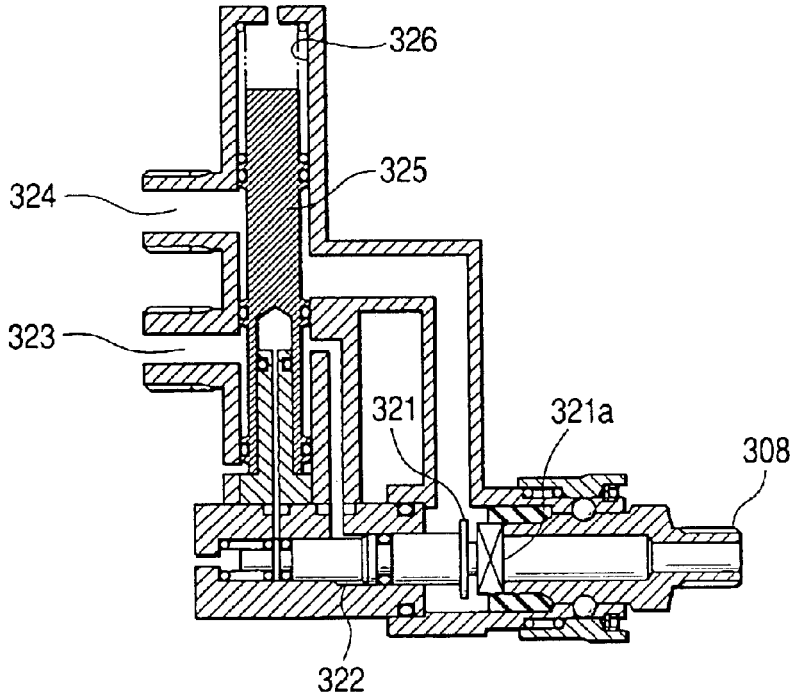
FIG. 12 is a sectional view the same as FIG. 11 in a state of mounting a low pressure plug.

As shown by FIG. 12, by mounting the low pressure plug 308 to a plug mounting portion 327 of the socket 320, the front end of the plug 308 presses an end portion 321*a* of the cut-off valve 321 to thereby open the cut-off valve 321 and communicates the inside of the socket 320 and the side of the plug 308. When the low pressure plug 308 is mounted, the pilot valve 322 maintains a state the same as an initial state, and adjusted pressure of the low pressure reducing valve 303 supplied via the low pressure port 324 is supplied to the low pressure plug 308.

Figure 13:
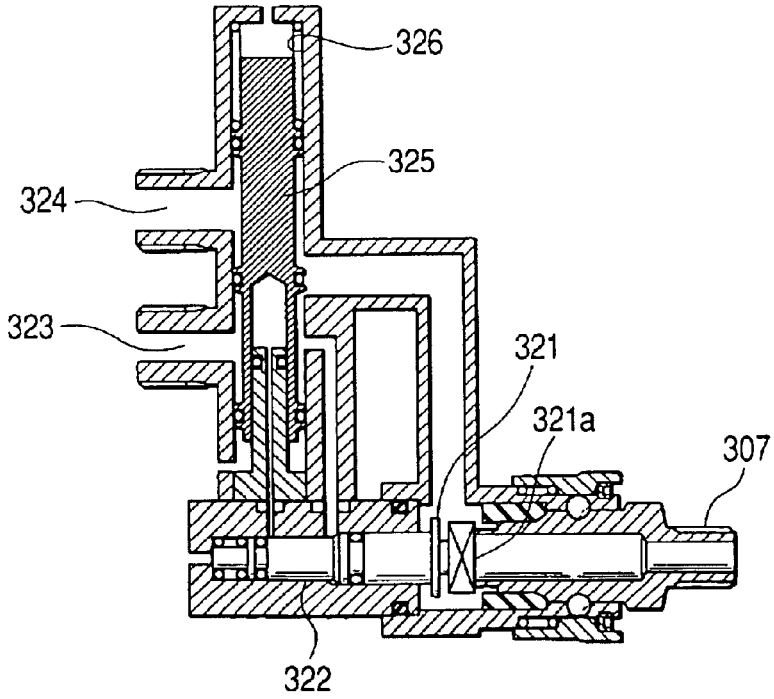
FIG. 13 is a sectional view the same as FIG. 11 in a state of mounting a high pressure plug.

As shown by FIG. 13, when the high pressure plug 307 having a long front end length is mounted to the plug mounting portion 327 of the socket 320, the pilot valve 322 is operated to a position of connecting the side of the switch valve and the pilot valve 322 supplies pilot air to the switch valve. The switch valve 325 is operated to switch to a position of communicating the high pressure port 323 to the inside of the socket by pilot air pressure supplied from the pilot valve 322 to the switch valve 325 and pressure adjusted by the high pressure reducing valve 302 is supplied to the high pressure plug 307.

Figure 14:
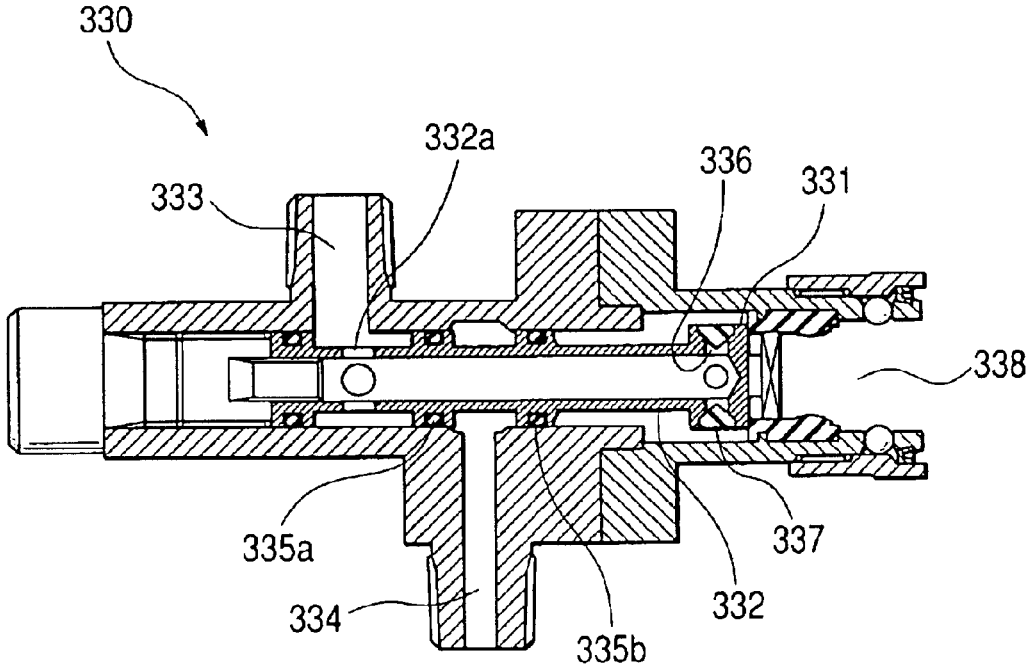
FIG. 14 is a sectional view showing a socket of a compressed air outputting apparatus according to a fourth embodiment of the invention.

Next, an explanation will be given of a fourth embodiment shown in FIG. 14 through FIG. 16. The inside of a socket 330 according to the embodiment is provided with a hollow valve member 332 integrally formed with a cut-off valve 331 operated by mounting the plug and the inside of a hollow portion of the hollow valve member 332 is normally communicated to a low pressure port 333 connected to the secondary side of the low pressure reducing valve 303 via an opening 332*a* formed at one end side of the valve member. O-rings 335*a* and 335*b* is arranged at an outer peripheral face of the hollow valve member 332 spaced apart from each other by an interval, and O-rings 335*a* and 335*b* open and close a high pressure port 334 connected to the secondary side of the high pressure reducing valve 302 and the inside of the socket 330. The O-ring 335*b* maintains a state of cutting off the high pressure port 334 at a moving amount thereof at a normal occasion in which the plug is not mounted and when the low pressure plug 308 is mounted. When the high pressure plug 307 is mounted, the cut-off valve 331 is moved by a large amount to thereby move the hollow valve member 332 to thereby communicate the high pressure port 334 to the inside of the plug 330.

At a position of the hollow valve member 332 proximate to the cut-off valve 331, there is formed an opening 336 for communicating the inside of the hollow valve member 332 and the inside of the socket 330 at a position proximate to the cut-off valve 331 of the hollow valve member 332. The opening 336 is mounted with a check valve 337 constituted by a ring-like elastic member permitting compressed air to flow from the inside of the hollow valve member 332 to the inside of the socket 330.

Figure 15:
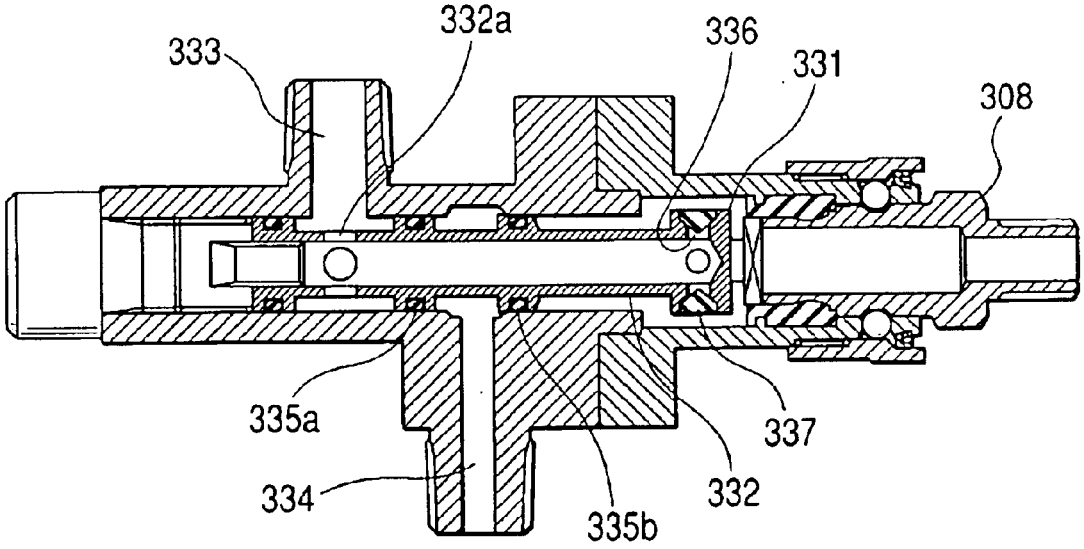
FIG. 15 is a sectional view the same as FIG. 14 in a state of mounting a low pressure plug.

As shown by FIG. 15, when the low pressure plug 308 is mounted to a plug mounting portion 338, the cut-off valve 331 is pressed to move by the front end of the plug and communicates the inside of the socket 330 and the side of the low pressure plug 308. The O-ring 335*b* maintains the state of closing the high pressure port 334, and compressed air from the low pressure port 333 is supplied to the side of the low pressure plug 308 via the check valve 337.

Figure 16:
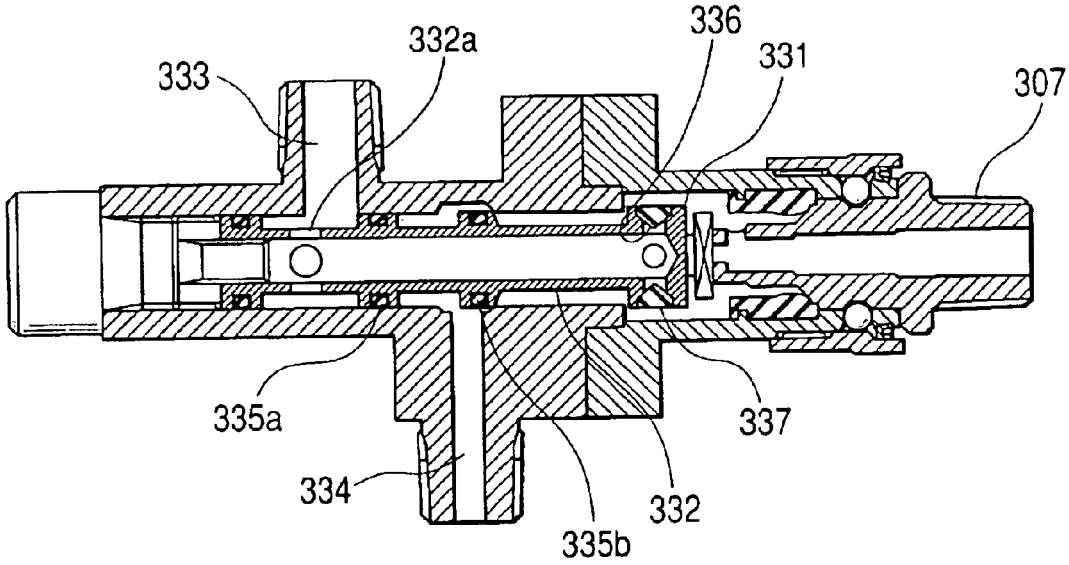
FIG. 16 is a sectional view the same as FIG. 14 in a state of mounting a high pressure plug.

As shown by FIG. 16, in the case of mounting the high pressure plug 307 having the longer length of the front end portion to the plug mounting portion, an amount of moving the cut-off valve moved by the front end of the plug is larger. Accordingly, the O-ring 335*b* of the hollow valve member 332 opens the high pressure port 334 to the inside of the socket 330. At this occasion, the check valve is closed by a pressure difference between low pressure at the inside of the hollow valve member 332 and high pressure at the inside of the socket 330. Therefore, air is prevented from flowing from the high pressure port 334 to the side of the low pressure port 333 and pressure adjusted by the high pressure reducing valve 302 is supplied to the high pressure plug 307 via the high pressure port 334.

Figure 17:
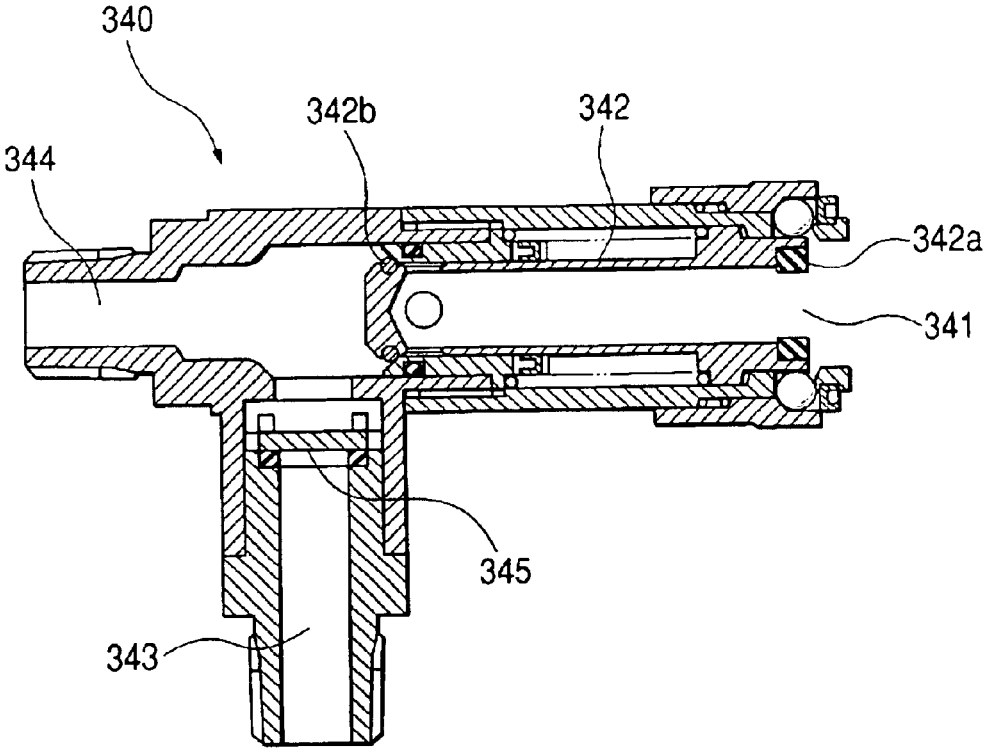
FIG. 17 is a sectional view showing a socket of a compressed air outputting apparatus according to a fifth embodiment of the invention.
Figure 18:
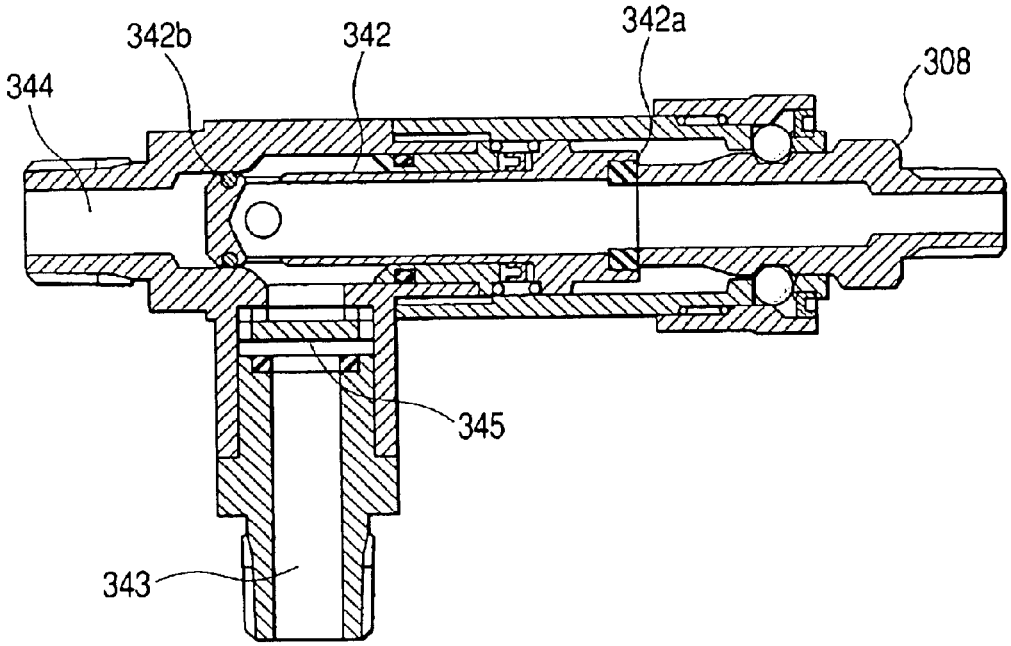
FIG. 18 is a sectional view the same as FIG. 17 in a state of mounting a low pressure plug.
Figure 19:
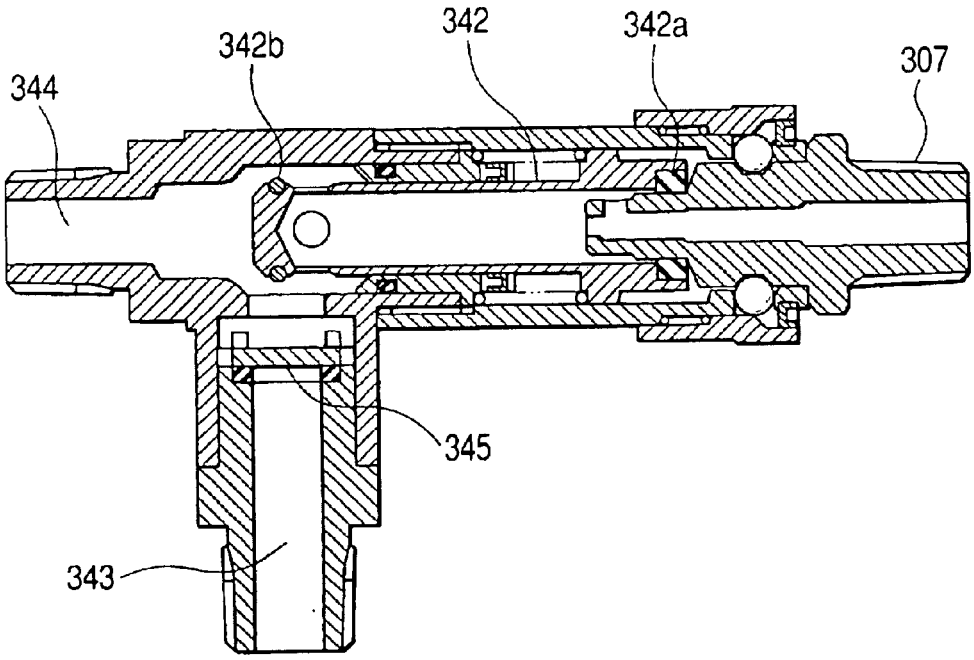
FIG. 19 is a sectional view the same as FIG. 17 in a state of mounting a high pressure plug.

Next, an explanation will be given of a fifth embodiment shown in FIGS. 17 through 19. According to the embodiment, there is arranged a cut-off valve member 342 in a shape of a hollow ring opposedly to a plug mounting portion 341 of a socket 340, and by mounting the plug, a valve member 342*b* formed at one end side of the cut-off valve member 342 is separated from a valve seat to thereby make air flow to the side of the plug. According to the embodiment, the valve member is moved by engaging an opening portion 342*a* formed at one end side of the cut-off valve member 342 and the low pressure plug. In the case of the high pressure plug 307, a small diameter portion at the front end of the high pressure plug 307 is contained at the inside of the hollow member and an enlarged diameter portion at a middle of the plug is engaged with an end face of the opening 342*a* to thereby move. Therefore, contrary to the above-described embodiment, in mounting the low pressure plug 308, the cut-off valve member 342 is moved by a larger amount. At a rear side portion of the socket 340, there are formed a low pressure port 343 connected to the low pressure reducing valve 303 and a high pressure port 344 connected to the high pressure reducing valve 302. The low pressure port 343 is arranged with a check valve 345 for permitting flow of air from the low pressure cut-off valve 303 into the socket 340 and cutting flow of air from the inside of the socket 340 to the side of the reducing valve. The high pressure port 344 is formed coaxially with the cut-off valve member 342 and is arranged to cut-off the high pressure port 344 by moving the valve member 342 of the cut-off valve member 342 by mounting the low pressure plug 308. At a normal occasion in which the plug is not mounted to the plug mounting portion 341, the high pressure port 344 is communicated to the inside of the socket 340, the inside of the socket 340 is filled with high pressure air and the check valve 345 arranged at the low pressure port 343 is closed by the high pressure air.

When the low pressure plug 308 is mounted to the socket 340, an end face of the opening 342*a* of the cut-off valve member 342 is engaged with an end face of the low pressure plug 308 and moved by a large distance, the valve member of the cut-off valve member 342 cuts off the high pressure port 344 and the inside of the socket 340. Then, when the high pressure air filled at the inside of the socket 340 is discharged to the side of the plug and the pressure is reduced, the check valve 345 installed at the low pressure port 343 is opened and adjusted pressure from the low pressure reducing valve 303 is communicated to the inside of the socket 340 via the low pressure port 343. The adjusted pressure is supplied to the low pressure plug 308 via an inner portion of the cut-off valve member 342 formed to be hollow.

When the high pressure plug 307 is mounted, the small diameter portion at the front end of the plug is brought into the opening of the cut-off valve member 342, the large diameter portion is engaged with the end face of the opening 342*a* and is moved by a small distance, and the valve member at a rear end of the cut-off valve member 342 does not reach a position of cutting off the high pressure port 344. Accordingly, the high pressure air is successively introduced into the socket 340 and pressurized air adjusted by the high pressure reducing valve 302 is supplied to the high pressure plug 307. At this occasion, the check valve 345 of the low pressure port 344 is cut off by the high pressure air at the inside of the socket, and the high pressure air does not flow back to the side of the reducing valve 303 via the low pressure port 343.

As described above, according to the invention, when exclusive plugs are installed for respective tools having different drive pressures used, since the socket is made to be able to mount any of the plugs, the plugs respectively used exclusively for high pressure and low pressure can be mounted to an opened socket without selecting the socket. Further, in the mounted state, the respective exclusive plugs are connected with compressed air at adjusted pressures respectively from the exclusive reducing valves. Therefore, compressed air at pressure different from pressure of driving the tool can be prevented from being supplied by erroneous connection or the like. Further, by arranging two of sockets commonly used to each of the reducing valves used exclusively for high pressure and low pressure, single pieces of the low pressure tool and the high pressure tool, or two pieces of the low pressure tools or the high pressure tools can simultaneously be used, and there can be provided a compressor providing a wide range of state of use by constituting of smaller numbers of reducing valves and sockets at low cost.

While only certain embodiments of the invention have been specifically described herein, it will be apparent that numerous modifications may be made thereto without departing from the spirit and scope of the invention.

What is claimed is:

1. An apparatus for outputting compressed air in a compressor to a plurality of pneumatic tools at a plurality of pressures, said apparatus comprising:

an air tank storing compressed air compressed by the compressor at a high pressure;

a pressure adjusting portion connected to said air tank and adjusting a pressure value of the compressed air in a region from the high pressure to zero, having a first side and a secondary side wherein the first side is connected to the air tank;

a pressure outputting portion connected to the secondary side of said pressure adjusting portion and outputting the adjusted compressed air to at least one of a first pneumatic tool driven at a first pressure and a second pneumatic tool driven at a second pressure, wherein the first pressure is larger than the second pressure, and wherein the adjusted compressed air is not output to the second pneumatic tool at the first pressure.

2. The apparatus according to claim 1, further comprising:

an opening/closing valve; and an opening/closing valve control apparatus, wherein said pressure adjusting portion comprises a reducing valve, and wherein said pressure outputting portion comprises:

a first socket connected to said reducing valve for the first pressure;

a second socket connected to said reducing valve for the second pressure via said opening/closing valve, and wherein said opening/closing valve control apparatus closes said opening/closing valve when the adjusted pressure exceeds a predetermined pressure value.

3. The apparatus according to claim 1, wherein a plurality of units comprising said pressure adjusting portion and said pressure outputting portion are connected to said air tank.

4. An apparatus for outputting compressed air in a compressor to a plurality of pneumatic tools at a plurality of pressures, said apparatus comprising:

an air tank storing compressed air compressed by the compressor at a high pressure;

a pressure adjusting portion connected to said air tank and adjusting a pressure value of the compressed air in a region from the high pressure to zero; and a pressure outputting portion connected to a secondary side of said pressure adjusting portion and outputting the adjusted compressed air to at least one of a first pneumatic tool driven at a first pressure and a second pneumatic tool driven at a second pressure, wherein the first pressure is larger than the second pressure, wherein the adjusted compressed air is not output to the second pneumatic tool at the first pressure, wherein said pressure outputting portion comprising a socket to which both a first plug for the first pneumatic tool and a second plug for the second pneumatic tool are connectable, wherein the adjusted compressed air is output to the first pneumatic tool at the first pressure when the first plug is connected to said socket, and wherein the adjusted compressed air is output to the second pneumatic tool at the second pressure when said second plug is connected to said socket.

5. The apparatus according to claim 4, wherein said pressure adjusting portion comprises a reducing valve, and wherein said socket comprises an opening/closing valve for opening and closing a path communicated to one of the first plug and the second plug in accordance with a pressure of the adjusted compressed air, and said opening/closing valve closes when the pressure of the adjusted compressed air exceeds a limit pressure for using the second pneumatic tool.

6. The apparatus according to claim 4, wherein said pressure adjusting portion comprises a first reducing valve and a second reducing valve, and wherein said first reducing valve and said second reducing valve is connected to said socket.

7. The apparatus according to claim 6, wherein said socket comprises a switch valve member provided inside thereof, and wherein said switch valve member is operated by mounting one of the first plug and the second plug, and said switch valve member selects to connect to one of the first pneumatic tool and the second pneumatic tool by making a stroke to move said switch valve member different in accordance with the mounted plug.

* * * * *